US005797706A

United States Patent [19]

Segrestin et al.

[11] Patent Number: 5,797,706

[45] Date of Patent: Aug. 25, 1998

[54] EARTH STRUCTURES

[75] Inventors: Pierre Segrestin, St.Germain-en-Laye; Jean Marc Jailloux, Sannois, both of France

[73] Assignee: Societe Civile des Brevets Henri Vidal, Paris, France

[21] Appl. No.: 578,570

[22] PCT Filed: Jun. 24, 1994

[86] PCT No.: PCT/IB94/00209

§ 371 Date: Jun. 28, 1996

§ 102(e) Date: Jun. 28, 1996

[87] PCT Pub. No.: WO95/00712

PCT Pub. Date: Jan. 5, 1995

[30] Foreign Application Priority Data

Jun. 24, 1993 [GB] United Kingdom ..... 9313095

[51] Int. Cl.[6] ..... E02D 29/02

[52] U.S. Cl. ..... 405/262; 405/284

[58] Field of Search ..... 405/262, 272, 405/284, 285, 286

[56] References Cited

U.S. PATENT DOCUMENTS

| | | | |
|---|---|---|---|
| 126,547 | 5/1872 | Hickcox . | |
| 228,052 | 5/1880 | Frost . | |
| 566,924 | 9/1896 | Morrin . | |
| 810,748 | 1/1906 | Haller et al. . | |
| 1,092,621 | 4/1914 | Worner . | |
| 1,414,444 | 5/1922 | Straight . | |
| 1,456,498 | 5/1923 | Binns . | |
| 1,762,343 | 6/1930 | Munster . | |
| 1,818,416 | 8/1931 | Meara . | |
| 1,965,169 | 7/1934 | Becker | 405/284 |
| 2,193,425 | 3/1940 | Lake . | |
| 2,235,646 | 3/1941 | Schaffer . | |
| 2,252,155 | 8/1941 | Baldwin . | |

(List continued on next page.)

FOREIGN PATENT DOCUMENTS

| | | | |
|---|---|---|---|
| 320529 | 4/1974 | Austria . | |
| 558564 | 12/1957 | Belgium | 405/284 |
| 2031077 | 5/1991 | Canada . | |
| 0002216 | 6/1979 | European Pat. Off. . | |
| 0079880 | 5/1983 | European Pat. Off. . | |
| 0047717 | 6/1983 | European Pat. Off. . | |
| 0047718 | 5/1984 | European Pat. Off. . | |
| 0170113 | 2/1986 | European Pat. Off. . | |
| 0197000 | 11/1986 | European Pat. Off. . | |
| 0212357 | 3/1987 | European Pat. Off. . | |
| 0318243 | 5/1989 | European Pat. Off. . | |

(List continued on next page.)

OTHER PUBLICATIONS

"Reinforced Soil Highway Slopes," Tensar® Technical Note, The Tensar Corporation, TTN-SR3, Feb. 1990.

Naccaferru® Gabions and Reno Mattress, "Terramesh System What It Is and How Can Be Used," International Reinforced Soil Conference, Glasgow, Sep. 10–12, 1990.

Componenti Strutturali A Caratteristiche Differenziate per La Salvaguardia E Recupero Del Territorio, Delle Acque E Dell'Ambiente.

Muri di Sostegno Con Paramento Vegetabile, Stampato nel Gennaio 1990.

(List continued on next page.)

*Primary Examiner*—Tamara L. Graysay
*Assistant Examiner*—Frederick Lagman
*Attorney, Agent, or Firm*—Banner & Witcofff Ltd

[57] ABSTRACT

An earth structure includes a plurality of elongated stabilizing elements in an earth mass behind a facing made up of facing panels. A plurality of connectors behind the facing connects the facing to the stabilizing elements. Each connector has a rear attachment portion attached to a respective stabilizing element, and each connector also has at least two spaced apart front attachment portions attached to a facing panel. The earth mass includes a first region of soil suitable for plant growth which also defines the region in which the connectors are located. A second region of structural back fill is provided which includes the stabilizing elements.

11 Claims, 5 Drawing Sheets

U.S. PATENT DOCUMENTS

| | | | |
|---|---|---|---|
| 2,313,363 | 3/1943 | Schmitt . | |
| 2,882,689 | 4/1959 | Huch et al. . | |
| 2,963,828 | 12/1960 | Belleveau . | |
| 3,036,407 | 5/1962 | Dixon . | |
| 3,252,287 | 5/1966 | Suzuki . | |
| 3,274,742 | 9/1966 | Paul, Jr. et al. . | |
| 3,316,721 | 5/1967 | Heilig . | |
| 3,332,187 | 7/1967 | Arcari . | |
| 3,390,502 | 7/1968 | Carroll . | |
| 3,418,774 | 12/1968 | Kocher et al. . | |
| 3,430,404 | 3/1969 | Muse . | |
| 3,557,505 | 1/1971 | Kaul . | |
| 3,570,253 | 3/1971 | Vidal . | |
| 3,686,873 | 8/1972 | Vidal . | |
| 3,936,987 | 2/1976 | Calvin . | |
| 3,995,434 | 12/1976 | Kato et al. . | |
| 3,998,022 | 12/1976 | Muse . | |
| 4,015,693 | 4/1977 | Warren . | |
| 4,110,949 | 9/1978 | Cambiuzzi et al. . | |
| 4,116,010 | 9/1978 | Vidal . | |
| 4,117,686 | 10/1978 | Hilfiker . | |
| 4,154,554 | 5/1979 | Hilfiker . | |
| 4,207,718 | 6/1980 | Schaaf et al. . | |
| 4,208,850 | 6/1980 | Collier . | |
| 4,228,628 | 10/1980 | Schlomann . | |
| 4,229,123 | 10/1980 | Heinzmann . | |
| 4,260,296 | 4/1981 | Hilfiker . | |
| 4,266,890 | 5/1981 | Hilfiker . | |
| 4,269,545 | 5/1981 | Finney | 405/284 X |
| 4,312,606 | 1/1982 | Sarikelle . | |
| 4,324,508 | 4/1982 | Hilfiker et al. . | |
| 4,329,089 | 5/1982 | Hilfiker et al. . | |
| 4,335,549 | 6/1982 | Dean, Jr. . | |
| 4,341,491 | 7/1982 | Neumann . | |
| 4,343,571 | 8/1982 | Price | 405/284 |
| 4,391,557 | 7/1983 | Hilfiker et al. . | |
| 4,449,857 | 5/1984 | Davis . | |
| 4,454,699 | 6/1984 | Strobl . | |
| 4,470,728 | 9/1984 | Broadbent . | |
| 4,494,892 | 1/1985 | Wojciechowski . | |
| 4,496,266 | 1/1985 | Ruckstuhl . | |
| 4,505,621 | 3/1985 | Hilfiker et al. . | |
| 4,514,113 | 4/1985 | Neumann . | |
| 4,524,551 | 6/1985 | Scheiwiller . | |
| 4,572,699 | 2/1986 | Rinninger . | |
| 4,608,795 | 9/1986 | Neuschaeffer et al. . | |
| 4,643,618 | 2/1987 | Hilfiker et al. . | |
| 4,661,023 | 4/1987 | Hilfiker . | |
| 4,710,062 | 12/1987 | Vidal et al. . | |
| 4,725,170 | 2/1988 | Davis . | |
| 4,776,728 | 10/1988 | Sprehn . | |
| 4,802,320 | 2/1989 | Forsberg . | |
| 4,818,150 | 4/1989 | Jaecklin . | |
| 4,825,619 | 5/1989 | Forsberg . | |
| 4,856,939 | 8/1989 | Hilfiker . | |
| 4,904,124 | 2/1990 | Egan . | |
| 4,909,010 | 3/1990 | Gravier . | |
| 4,914,876 | 4/1990 | Forsberg . | |
| 4,917,543 | 4/1990 | Cole et al. . | |
| 4,952,097 | 8/1990 | Kulchin . | |
| 4,952,098 | 8/1990 | Grayson et al. . | |
| 4,960,349 | 10/1990 | Willibey et al. . | |
| 4,961,673 | 10/1990 | Pagano et al. | 405/262 X |
| 4,998,397 | 3/1991 | Orton . | |
| 5,002,436 | 3/1991 | Sigourney | 405/262 |
| 5,004,376 | 4/1991 | Vidal et al. . | |
| 5,044,833 | 9/1991 | Wilfiker . | |
| 5,076,735 | 12/1991 | Hilfiker . | |
| 5,091,247 | 2/1992 | Willibey et al. . | |
| 5,156,496 | 10/1992 | Vidal et al. . | |
| 5,161,918 | 11/1992 | Hodel . | |
| 5,163,261 | 11/1992 | O'Neill . | |
| 5,190,413 | 3/1993 | Carey . | |
| 5,207,038 | 5/1993 | Negri . | |
| 5,257,880 | 11/1993 | Janopaul, Jr. . | |
| 5,259,704 | 11/1993 | Orgorchock . | |
| 5,350,256 | 9/1994 | Hammer . | |
| 5,451,120 | 9/1995 | Martinez-Gonzalez | 405/262 |
| 5,474,405 | 12/1995 | Anderson et al. . | |
| 5,487,623 | 1/1996 | Anderson et al. . | |
| 5,507,599 | 4/1996 | Anderson et al. | 405/262 X |

FOREIGN PATENT DOCUMENTS

| | | | |
|---|---|---|---|
| 0379466 | 1/1990 | European Pat. Off. . | |
| 0391857 | 10/1990 | European Pat. Off. . | |
| 0430890 | 6/1991 | European Pat. Off. . | |
| 0437171 | 7/1991 | European Pat. Off. . | |
| 0472993 | 3/1992 | European Pat. Off. . | |
| 0574233 | 12/1993 | European Pat. Off. . | |
| 0603460 | 6/1994 | European Pat. Off. . | |
| 0392474 | 11/1908 | France . | |
| 1360872 | 4/1963 | France . | |
| 2055983 | 4/1971 | France . | |
| 2233857 | 1/1973 | France . | |
| 2216823 | 8/1974 | France . | |
| 2303121 | 10/1976 | France . | |
| 2367147 | 5/1978 | France . | |
| 2546558 | 11/1984 | France . | |
| 2591064 | 12/1987 | France . | |
| 2610962 | 8/1988 | France . | |
| 2633650 | 1/1990 | France . | |
| 39782 | 1/1937 | Germany | 405/262 |
| NR0206822 | 12/1959 | Germany . | |
| 2414202 | 10/1975 | Germany . | |
| 2626650 | 12/1977 | Germany . | |
| 2944550 | 4/1981 | Germany . | |
| 3025883 | 1/1982 | Germany . | |
| 3401629 | 7/1984 | Germany . | |
| 8326632 U | 10/1985 | Germany . | |
| 410330 | 9/1991 | Germany . | |
| 586016 | 9/1981 | Japan . | |
| 57-180719 | 11/1982 | Japan . | |
| 2-120411 | 5/1990 | Japan | 405/262 |
| 209522 | 8/1990 | Japan . | |
| 3-144014 | 6/1991 | Japan . | |
| 3-180617 | 10/1991 | Japan . | |
| 6-88339 | 3/1994 | Japan . | |
| 6-257155 | 9/1994 | Japan . | |
| 84735 | 6/1920 | Switzerland . | |
| 205452 | 9/1939 | Switzerland . | |
| 657651A5 | 9/1996 | Switzerland . | |
| 27174 | of 1930 | U.S.S.R. . | |
| 894038 | 12/1981 | U.S.S.R. . | |
| 1090803A | 5/1984 | U.S.S.R. . | |
| 0000336 | 2/1871 | United Kingdom . | |
| 0014528 | 6/1913 | United Kingdom . | |
| 08457863 | 8/1960 | United Kingdom . | |
| B1069361 | 5/1967 | United Kingdom . | |
| 1385207 | 2/1975 | United Kingdom . | |
| 2014222 | 11/1979 | United Kingdom . | |
| 2073281 | 10/1981 | United Kingdom . | |
| 2116222 | 9/1983 | United Kingdom | 405/262 |
| 2127872 | 4/1984 | United Kingdom . | |
| 2131063 | 7/1985 | United Kingdom . | |
| WO8802050 | 3/1988 | WIPO . | |

OTHER PUBLICATIONS

"Polyester Fabric as Reinforcement in Soil," B.B. Broms, Department of Soil and Rock Mechanics, Royal Institute of Technology, Stockholm, Sweden, C.R. Coll. Int. Sols Textiles, Paris 1977.

"An Earth Dam with a Vertical Downstream Face Constructed Using Fabrics," F. Kern, Centre Technique du Génie Rural, des Eaux et des Forêts, Aix–en–Provence, France, C.R. Coll. Int. Sols Textiles, Paris 1977.
"Geotextiles 2000," Techno–economic Study on the Use of Geotextiles Final Report, vol. III Technical Study, Battelle Geneva Research Centres, Oct. 1984.
"Recent Experience with Fabric–Faced Retaining Walls," E.D. Schwantes, Jr., Consulting Geotechnical Engineer, Huntington Beach, California, USA, Second International Conference on Geotextiles, Las Vegas, U.S.A.
"Begrünbare Stützkonstruktion aus geotextilarmiertem Erdmaterial," Textomur® (Schweizer Patent Angemeldet).
"Reinforcement of Earth Slopes and Embankments," National Cooperative Highway Research Program Report 290, Transportation Research Board, National Research Council.
Landolt, a reliable Swiss Company in the Canton of Glarus.
"The Development of Terratrel for the Construction of Steep Slopes," Reinforced Earth Company, International Reinforced Soil Conference, Glasgow, Sep. 10–12, 1990.
Terratrel (appears to be a brochure).
Matrex™ Soil Stabilization Systems from The Reinforced Earth Company.
Matrex™ Soil Stabilisation Systems, A speciality engineered product from The Reinforced Earth Company.
The Reinforced Earth Company leaflet.
Textomur® Dsa Grüne System, Le Systeme Vert, Il Sistema Verde, The Green System.
Textomur® Soutènemenet d'un talus de grande surface lors de l'élargissement de la voie ferroviaire <<SZU>>, Tiré à part du <<Schweizer Baublatt>> No. 85 du 27 Oct. 1987.
Textomur® Grossflächige Hangischerung beim Ausbau der SZU, Separatdruck aus <<Schweizer Baublatt>> Nr. 85 vom 27 Oct. 1987.
"Steilwand im Textilkorset," Technik, Tages–Anzeiger 21 Sep. 1989.
AASHTO–AGC–ARTBA Joint Committee, Subcommittee On New Highway Materials, Task force 27 Report "In Situ Soil Improvement Techniques" (Undated).
Silifrance Product Information Sheet (Undated).
Besser Co. "The Beauty of Concrete Block" Information Brochure (Undated).
Rockwood Classic Retaining Wall System Product Information Sheet (Undated).
Earthworks™ Retaining Wall System Product Information Sheet (Undated).
EarthStone™ Erosion Control/Retaining Wall Ssytem Product Information Sheet (Undated).
Rockwood Retaining Walls, Inc. Product Information Sheet (Undated).
RISI Stone Retaining Wall Systems "Preserving Our Environment" Information Brochure (1976).
Reinforced Earth Co.® "Design of Live Storage Structures Using Reinforced Earth®" (1983).
Reinforced Earth Co.® "Industrial Applications of Reinforced Earth® Structures" (1988).
Versa–Lok® Retaining Wall Systems Information Brochure (1989).
Structural Block Systems, Inc. "Introducing Radial Block" (1990).
Allan Block™ Retaining Walls "A Mortarless, Stackable Concrete Block Retaining Wall System" (1990).
Interim, Highway Bridges, Division I—Design, 5.8.7.2 "Polymeric Reinforcements" (1991).
Westblock Products, Inc. "GravityStone™" (1992).
Genesis™ Highway Wall System (1992).
Hunziker "Cobra" (1992).
Keystone™ Retaining Wall Systems "Standard Unit" (1993).
Keystone™ Retaining Wall Systems "Mini and Cap Unit" (1993).
Publication "Modular Concrete Block" (1984).
Publication "Paving Stone: A New Look with Old World Charm" (1984).
Publication "Methods of Making Split Corners" (1985).
Hollow Building Assoc. Handbook "Standard Load–Bearing Wall Tile" (1924).
Concrete Masonry Pictorial, vol. 33 No. 3, c. 1977 p. 5.
The Contractor, vol. 2 No. 9, Oct. 1987, pp. 13–16.
Hilifiker Literature, date unknown but prior to 1993.
"VSL Retained Earth Metal Facing Wall System Installation Manual" brochure. On information and belief, this document was submitted to the Florida Department of Transportation in 1991 or early 1992.
"Grassy Slope Pleases Planners" from Construction Weekly, vol. 3 No. 15, 17 Apr. 1991.

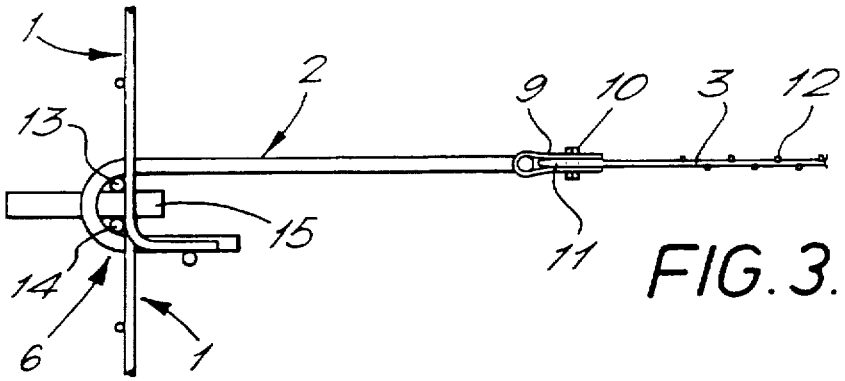
FIG. 3.
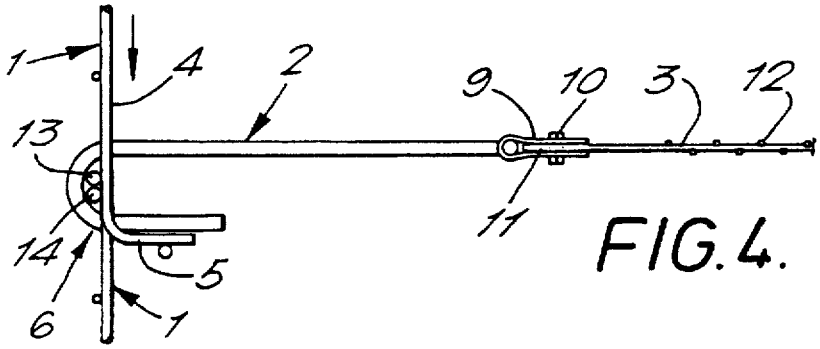
FIG. 4.
FIG. 5.
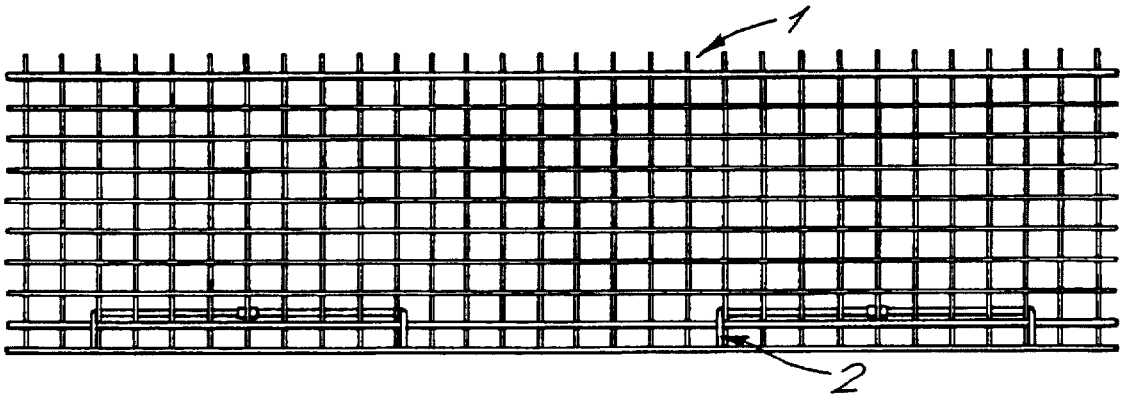

EARTH STRUCTURES

The invention relates to earth structures, certain components for use in earth structures and to methods of constructing earth structures.

It is known from European Patent Application No. 0 318 243 to provide an earth structure frictionally stabilised by a plurality of elongate stabilising elements in the form of strips extending rearwardly from a facing of the structure into an earth mass. The earth is stabilised throughout the mass by frictional engagement with the strips, thereby enabling the earth mass to behave as an elastic material with greatly improved resistance to failure. The facing of the known structure consists of a series of rows of "C" shaped mesh facing panels arranged one above another. The panels in each row are supported by laterally spaced support straps. These are also "C" shaped, each having an upright front portion in front of the panels and relatively short upper and lower rearwardly extending portions. These upper and lower portions are connected to an earth stabilising strip. Thus the forward end of each stabilising strip is located between a rearwardly extending upper portion at the top of a support strap in one row and a rearwardly extending lower portion at the bottom of a support strap in the row above. A bolt passes through the upper and lower rearwardly extending portions and the stabilising strip to form a secure connection.

The advantages of using facing panels formed of mesh are that they are lightweight and thus inexpensive compared to eg. concrete panels and that they allow the growth of vegetation on the facing, thus giving it a "green" appearance. However, because of their lightweight nature, the mesh facing panels are flexible and thus subject to deformation. In particular, there is a tendency for the facing panels to bulge out where they span between the laterally spaced support straps. If it were desired, for aesthetic or other reasons, not to use the support straps and to connect the stabilising strips directly to the mesh facing panels, there would be an increased tendency for the panels to deform.

Viewed from one aspect, the invention provides an earth structure comprising a plurality of elongate stabilising elements in an earth mass behind a mesh facing, and a plurality of connectors behind the facing and connecting it to the stabilising elements, each connector having a rear attachment portion attached to a respective earth stabilising element, and having at least two spaced apart front attachment portions attached to the mesh facing.

It will be appreciated that the forward earth pressure on the mesh facing is withstood by the stabilising elements connected to the facing via the connectors. By attaching each connector to the mesh facing by the spaced apart front attachment portions, the load on the mesh facing applied by the connector is distributed between those attachment portions, thereby reducing the deflection of the facing.

In fact, the connector arrangement may be useful with other types of facing where it is desired to limit the deflections by distributing the load thereon.

Thus, viewed from another aspect, the invention provides an earth structure comprising a plurality of elongate stabilising elements in an earth mass behind a facing, and a plurality of connectors behind the facing and connecting it to the stabilising elements, each connector having a rear attachment portion attached to a respective earth stabilising element, and having at least two spaced apart front attachment portions attached to the facing. For example, the facing may be made of a sheet or sheets of eg. metal.

The invention also provides a connector for use in the earth structures described herein. In one broad aspect, the invention provides a connector for connecting an earth stabilising element and a facing, comprising a rear attachment portion for attachment to an earth stabilising element, and at least two spaced apart front attachment portions for attachment to a facing. The front attachment portions may take any convenient form but are preferably arranged to hook on to a bar or lug of the facing. Thus each front attachment portion may be in the form of a hook. In a preferred embodiment, the connector has two front attachment portions and is substantially "V" shaped. The front attachment portions are preferably spaced apart in a horizontal or lateral direction. The connector may be formed by bending a bar, for example a 14 mm diameter steel bar.

The connectors are preferably capable of pivoting about a horizontal axis at the facing. This can advantageously permit the connectors to be at an appropriate orientation, normally horizontal, for any angle of facing. In general, the slope of the facing can vary between 45° to the horizontal and vertical (90° to the horizontal). Pivotability of the connectors can advantageously be achieved by the hooks described above, which can pass round at least one substantially horizontal bar of the facing.

The connectors extend rearwardly into the earth so as to have a length in this direction which is substantially less than the length of the stabilising elements, for example less than one quarter, preferably less than one fifth.

In a preferred embodiment, a mesh facing comprises mesh panels arranged one above another, and the connectors connect a substantially horizontal bar of a lower facing panel with a substantially horizontal bar of an upper facing panel arranged above the lower facing panel. Thus the connectors serve to connect lower and upper facing panels together as well as to connect the facing to the stabilising elements. The facing may be made up of mesh facing panels which are substantially "L" shaped in vertical cross-section. Typically, the front portion of the "L" will be substantially longer than the rearwardly extending portion, for example at least five times longer and preferably ten times longer.

The use of "L" shaped panels rather than the known "C" shaped panels results in more potential deformation along the horizontal joint between the panels, because the rearwardly extending portion at the top of the panels is omitted, thereby reducing the stiffness of the panels. However, the use of a connector having at least two spaced apart attachment portions attached to the facing panel compensates for the loss of stiffness.

The "L" shaped panels can be used to form vertical facings and also non-vertical facings, even if the angle between the front portion and rearwardly extending portion of the "L" is 90°, if the connectors are pivotably attached and thus do not have to be at the same orientation as the rearwardly extending portion of the "L". This advantageously permits standardisation of the facing panels for facings of different slopes. Moreover, a particular facing can have portions of different slopes whilst still using the same panels.

The connectors are preferably arranged to permit relative vertical movement between the lower and upper facing panels. This can be achieved by the hooks described above, having a vertical play which is greater than the combined thickness of the two horizontal bars. Thus, in a preferred construction method, the horizontal bar of an upper facing panel may be spaced upwardly from the horizontal bar of a lower facing panel by a wedge. This determines the position of the connector and thus the position of the stabilising element in the earth behind the facing. Once the upper facing panel has been backfilled the wedge can be removed and as settlement of the backfill takes place the upper facing panel can move downwardly by the thickness of the wedge before its horizontal bar engages the horizontal bar of the lower facing panel. The lower facing panel is therefore not pushed downwardly by the upper facing panel and thus any tendency for it to bulge forwardly is significantly reduced. In practice, at least two facing panels above each wedge will normally be backfilled before the wedge is removed. The use of "L" shaped facing panels, in preference to "C" shaped panels, advantageously permits relative vertical movement between lower and upper panels.

The stabilising elements may take various forms and may for example be in the form of elongate ties connected at their rear ends to dead men anchors in the earth. Such a system operates by retaining a mass of earth between the facing and the dead men anchors. Preferably, however, the stabilising elements are in the form of strips which stabilise the earth by frictional interaction therewith. It is preferred for the rear attachment portions of the connectors to extend laterally. The stabilising strips may for example be attached to the connectors by ties which loop round the laterally extending rear attachment portions. This arrangement is useful if the strips are metal strips, since the forward end of the strips can be secured to the ties by a vertical bolt. Alternatively, the stabilising strips may be attached to the connectors by looping round the laterally extending rear attachment portions, whereby each strip has first and second portions which extend rearwardly from its respective connector. Such an arrangement may be useful if the strips are geosynthetic strips which are generally quite flexible and capable of forming a loop. In order that the turn at the loop is not too tight, a tube of larger diameter may be provided round the laterally extending rear attachment portion of the connectors.

The earth mass behind the facing may be structural backfill selected in a known manner to co-operate with the stabilising elements to produce a stable structure. The entire earth mass behind the facing may consist of such structural backfill. Preferably, however, the earth structure comprises a first region of earth of a first type adjacent to the facing, in which first region the connectors are located, and a second region of earth of a second type behind the first region, in which second region the stabilising elements are located. Thus, when a mesh facing is used, the first earth type may be stones or aggregate visible through the openings in the mesh to give support to the mesh and a "stone" finish, or it may be a type of soil, such as top soil, suitable for establishing plant growth to produce a "green" facing. In both cases, the second earth type may be structural backfill. Earth of a type suitable for plant growth will generally contain organic matter and possibly fertilizers and will tend to have a high moisture content. This produces good conditions for plant growth but aggressive conditions for the earth stabilizing elements. However, by using connectors which are located in the first region of earth, the stabilising elements, which are located in the second region of earth, are not exposed to the aggressive conditions. It is thus possible to use conventional stabilising elements.

On the other hand, the connectors can be designed with dimensions, the material they are made from and/or protective measures which take account of the aggressive conditions. For example, the connector may have a thickness which is greater than that which is structurally needed. Thus, where a connector made from a 10 mm diameter bar would support the load, a 14 mm bar may be used. This is an overthickness of 4 mm, as compared to a 1 mm overthickness which is typically used for a metal stabilising strip for a 70 year service life. Possible protective measures for the connector are galvanising or other metallic coating, e.g. zinc-aluminium alloy, applied by spraying or dipping. Plastic coatings, such as polyamide, polyurethane or epoxy, may also be used.

In fact, the provision of first and second earth regions is useful even if the connectors are attached to the facing at only one front attachment point, as well as when there are at least two front attachment portions.

Thus, viewed from a further aspect, the invention provides an earth structure comprising a plurality of elongate stabilising elements in an earth mass behind a facing, and a plurality of connectors behind the facing and connecting it to the stabilising elements, wherein the earth mass comprises a first region of earth of a first type adjacent to the facing, in which first region the connectors are located, and a second region of earth of a second type behind the first region, in which second region the stabilising elements are located. Whilst the facing is preferably a mesh facing, there are other possibilities, such as a facing with openings through which plants can grow, for example being made up of concrete elements.

In a preferred structure, the first and second regions of earth are separated by geosynthetic material, such as a sheet or sheets of geotextile. This helps to ensure that the stabilising elements are not exposed to the first earth region and also, by providing a clear boundary between the two earth regions, helps to ensure that the first region is of the correct thickness. The geotextile is preferably a non-woven product with good filtration and drainage properties.

Certain preferred embodiments of the invention will now be described by way of example and with reference to the accompanying drawings, in which:

FIG. 1 is a front elevation of a first type of mesh facing panel with three connectors, for use in a vertical facing;

FIG. 2 a plan view of one of the connectors attached to the facing panel and to a stabilising strip;

FIGS. 3 and 4 are respective side views of the connector, to an enlarged scale, before and after removal of a wedge;

FIG. 5 is a front elevation of a second type of mesh facing panel with two connectors, for use in a sloping, non-vertical facing;

Figure 1:
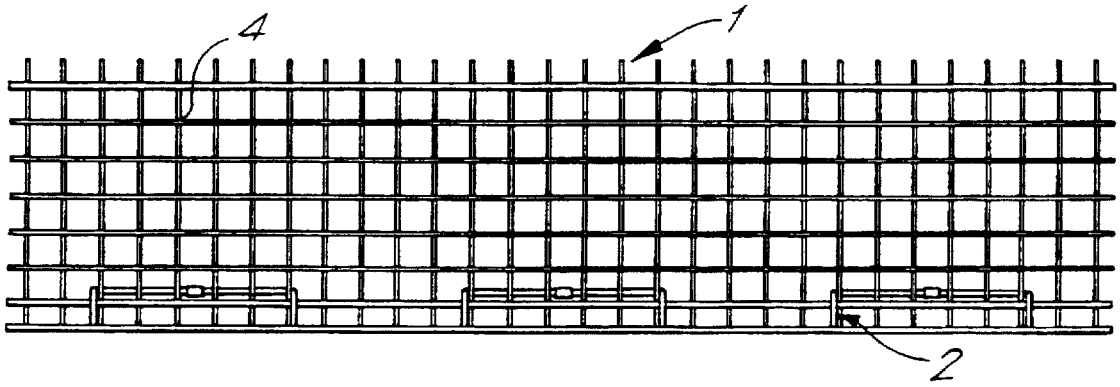
Figure 2:
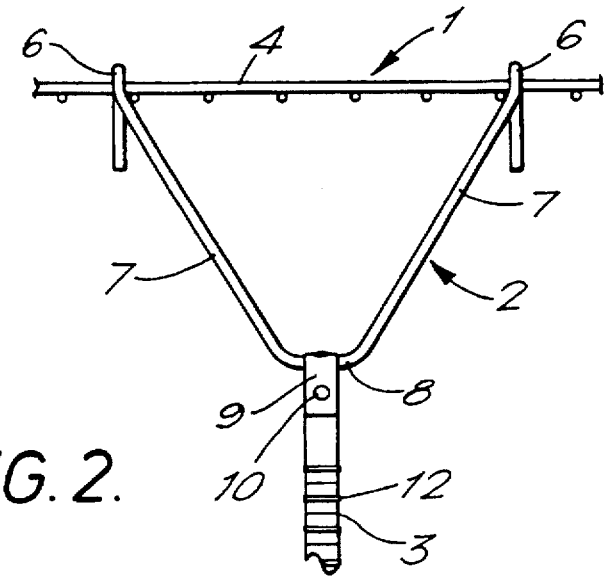

Referring to FIGS. 1–4, a mesh facing panel 1 is provided with three connectors 2 each connected to an earth stabilising element in the form of a galvanised steel strip 3. The facing panel 1 has a vertical facing portion 4 and a relatively short rearwardly extending portion 5 at its lower end, so as to be substantially "L" shaped, the portions 4 and 5 being perpendicular to each other. Each connector 2 has two front attachment portions for attachment to the facing panel 1, each in the form of a hook 6, so that the connector consists of a double-hook arrangement. Extending rearwardly from the double-hook are a pair of converging portions 7 which are joined at the rear of the connector by a laterally extending rear attachment portion 8. A hair pin shaped lug 9 passes round the laterally extending portion 8 and is connected to the front end of the stabilising strip 3 by a vertical bolt 10. The strip has an integrally thickened portion 11, as described in British Patent Application No. 2177140, and a series of ribs 12 for improving frictional interaction with the surrounding earth, as described in British Patent No. 1563317.

Referring to FIGS. 3 and 4, each hook 6 passes round a lower horizontal bar 13 of an upper facing panel and round an upper horizonal bar 14 of a lower facing panel. At the time of construction, a temporary wood wedge 15 is placed at the attachment point between the bars 13 and 14. After the upper panel, and the next upper panel above that, have been backfilled with earth the wedge is removed, so that as the backfill settles and moves the stabilising strip 3 together with the connector 2 downwardly, the upper panel is able to move downwardly from the position shown in FIG. 3 to that shown in FIG. 4. Thus the upper panel can move downwardly by the thickness of the wedge, which may be 4% of the height of the panel, before it starts to push downwardly on the lower panel, thereby reducing the tendency for the lower panel to bulge forwardly.

Thus whilst the double hook arrangement helps to reduce forward deflection of the panels as they span horizontally between the connector attachment points, the arrangement also permits relative vertical movement between vertically adjacent panels and this tends to reduce forward deflection of the panels as they span vertically between vertically adjacent connectors.

The facing panel 1 shown in FIGS. 1–4 is formed of electro-welded steel mesh with a nominal height of 0.625 m and a width of 3 m. The mesh bars are spaced both vertically and horizontally by 100 mm. The vertical bars have a diameter of 10 mm and the horizontal bars have a diameter of 8 mm apart from the top bar and the last two bottom bars (one in the facing portion 4 and the other in the rearwardly extending portion 5) which have a diameter of 14 mm for added stiffness. The use of a lighter facing panel is possible, being more cost effective and appropriate for low height and/or temporary structures. The facing panels have the same geometry but the diameters of all the bars are reduced by for example 2 mm.

The connectors shown in FIGS. 1–4 are bent from a 14 mm galvanised steel bar. The inner vertical dimension of the hooks 6 is about 60 mm. The length of the connector, in the direction extending rearwardly into the earth, is about 0.4 m. The centre-to-centre spacing of the connectors is about 1 m and their width, which is the spacing between the hooks 6, is about 0.55 m. The deflection of the facing panels 1 in the horizontal plane of the connectors and at their centres may typically be 4–6 mm. The maximum deflections between the connectors are less. At the edges of the panels the deflection may be about 10 mm. These values are acceptable.

Figure 6:
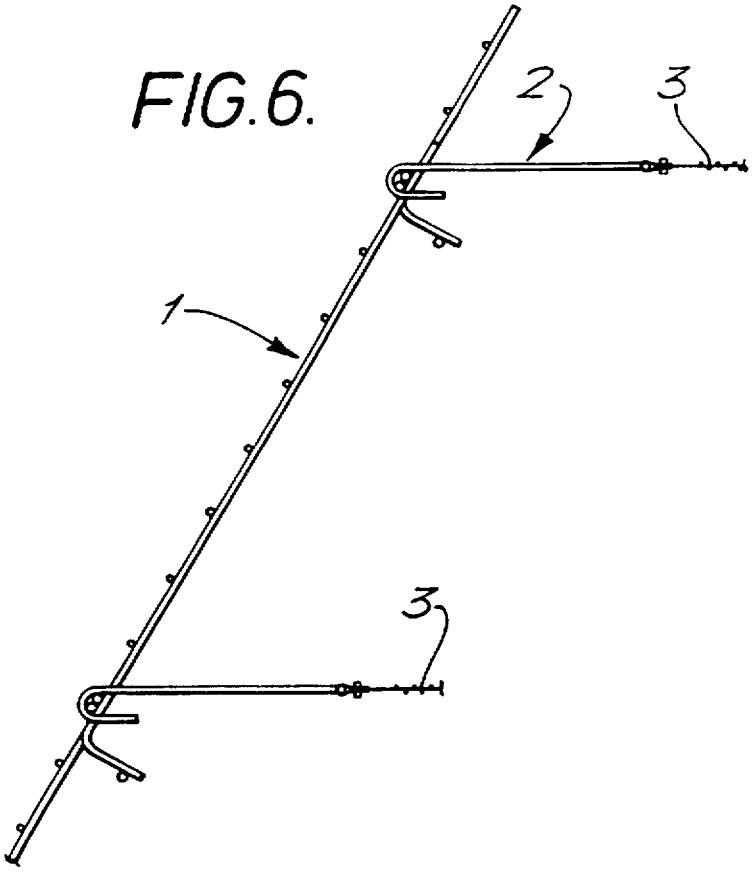
FIG. 6 is a side view of the sloping facing.

FIGS. 5 and 6 show a second type of mesh facing panel 2 for use in a sloping, non-vertical facing (60° to the horizontal). The main difference from the first type of facing panel arrangement is that only two connectors 2 are used, each having a width of about 0.85 m and being located at a centre-to-centre spacing of about 1.7 m for a 3 m wide panel. In addition, the panel is of greater height, having a nominal vertical height of 0.715 m. The deflection of the facing panels in the horizontal plane of the connectors and at their centres may typically be about 6 mm, with a maximum deflection of about 3 mm between the connectors. At the edges of the panels the deflections may be negative (rearward), e.g. about 4 mm.

It will be noted that the rearwardly extending portions 5 of the facing panels of FIGS. 5 and 6 are perpendicular to the facing portions 4, as in the case of the vertical facing. This is possible because the connection between each connector 2 and two vertically adjacent panels permits pivoting of the upper facing panel to the desired angle. Thus facing panels having a right angle between their facing portion 4 and rearwardly extending portion 5 can be used to form facings of various slopes, even permitting a change in the slope in the same structure. This is advantageous in that it enables standardisation of the facing panels.

As apparent from FIGS. 4 and 6, at the horizontal joint between vertically adjacent panels the upright bars are simply juxtaposed. There is no recess and the hooks 6 of the connectors are very discreet, the major part of the connectors being behind the facing. The vertical joint between adjacent panels in the same course is also a simple juxtaposition.

Figure 7:
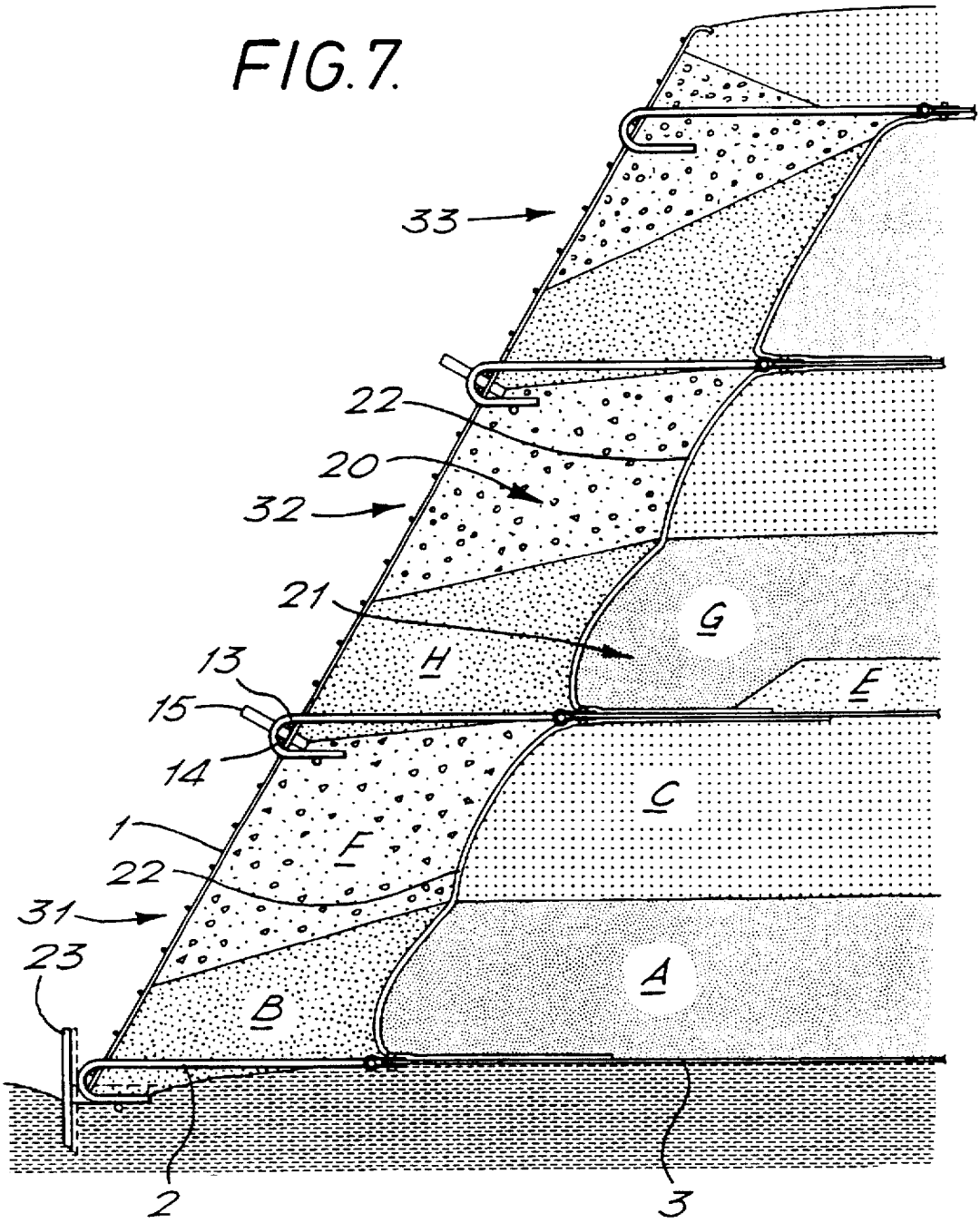
FIG. 7 is a vertical cross-section through an earth structure with a sloping facing.

The earth structure shown in FIG. 7 has a first region 20 of soil suitable for plant growth, and a second region 21 of structural backfill. The two regions are separated by geotextile sheets 22. The earth in the first region 20 may be a fine soil such as a silty sand that provides a certain water retention capacity. It can be top soil if the humus content is low and if compacting can be sufficiently achieved. The earth in the second region 21 will tend to be a coarser material with good drainage properties and less aggressive to the stabilising elements. A jute backing or "Enkamat" (trade mark) or the like (not shown in the drawings) is normally placed immediately behind the mesh facing panels to retain fine soil particles until vegetation is established.

Figure 8:
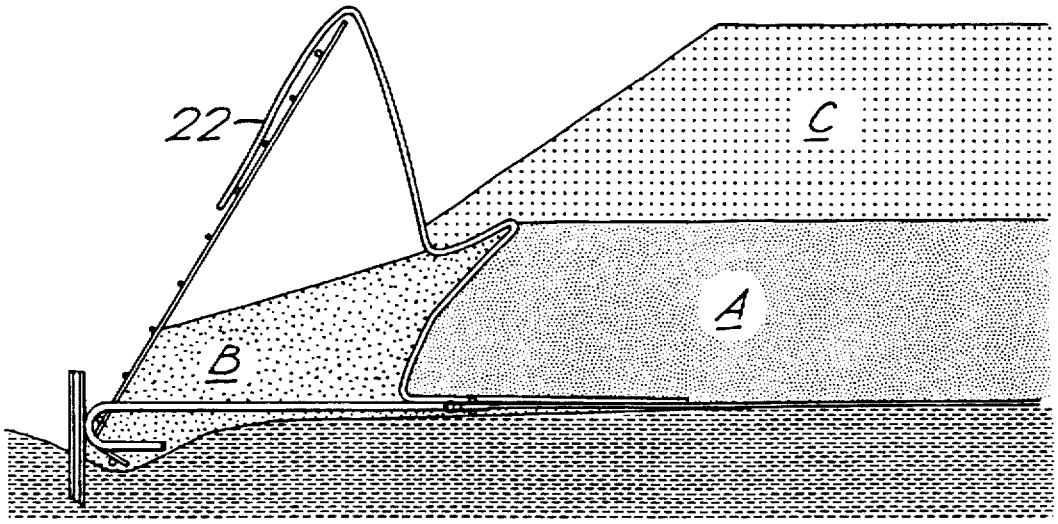
FIGS. 8 and 9 are vertical cross-sections similar to FIG. 7 and showing the structure during certain stages of construction.
Figure 9:
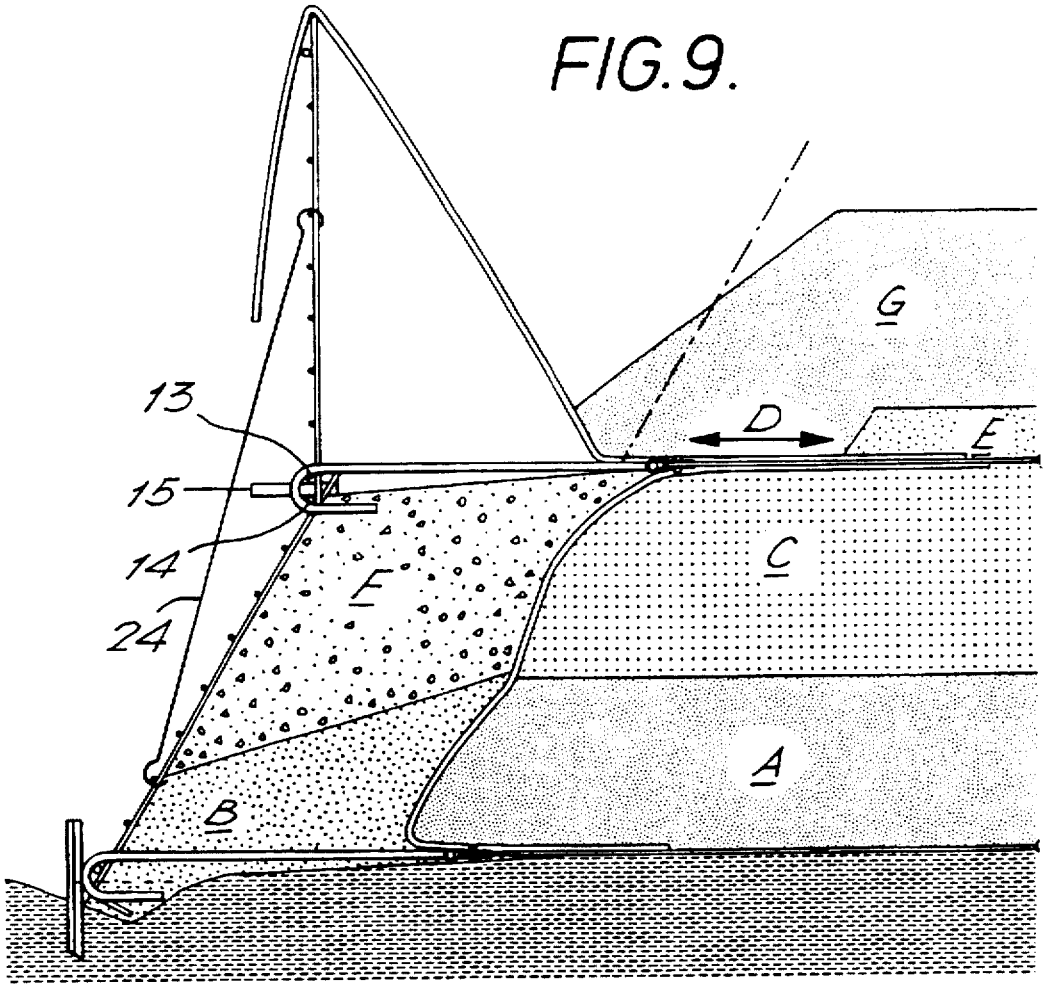

The construction of the earth structure will now be described with reference to FIGS. 7, 8 and 9. Posts 23 are driven into the foundation to provide alignment of a first course 31 of facing panels 1. A facing panel of the first course 31 with connectors 2 and stabilising strips 3 is placed and a first geotextile sheet 22 is laid on the soil behind the facing panel. A first layer A of structural backfill is placed on the stabilising strips 3. The geotextile sheet 22 is laid back along layer A and a layer B of top soil is placed between the panel 1 and the geotextile sheet 22. The geotextile sheet 22 is hung on the facing panel 1, as seen in FIG. 8, and a second layer C of structural backfill is placed on the first layer A. The geotextile sheet 22 is removed from the facing panel 1 and passed back over layer C. A facing panel 1 of a second course 32 is placed on the facing panel of the first course, along with its connectors 2 and stabilising strips 3. The facing panel 1 is positioned vertically with a wedge 15 between lower horizontal bar 13 and upper horizontal bar 14 of the panel below. It is held in place by a temporary stay 24. The stabilising strips 3 are adjusted as shown by arrow D in FIG. 9 to obtain the correct positioning of the facing panel. A second geotextile sheet 22 is laid on the strips 3 and a small volume E of backfill is placed on the strips to fix them in position. The geotextile sheet is folded back to leave a gap behind the facing panels 1 which are then backfilled with top soil layer F. The top soil in layers B and F is carefully compacted. The geotextile sheet 22 in the second course is hung on the facing panel of the second course, as shown in FIG. 9, and a backfill layer G is placed on the second course of stabilising strips 3, in a similar manner to the placement of layer A described above. The stay 24 is removed and the panel 1 of the second course 32 is tilted back to the correct orientation and backfilled with top soil layer H, equivalent to layer B described above. The process is continued with further courses of facing panels. In the last course, which in this case is the third course 33, the connectors 2 are hooked to a horizontal bar below the top of the panel 1, so that it can be buried and the tops of the upright bars of the panel can be bent rearwardly and downwardly for safety. The wood wedges 15 are then removed to enable the facing panels to move downwardly as the backfill settles, without significant bulging.

Figure 10:
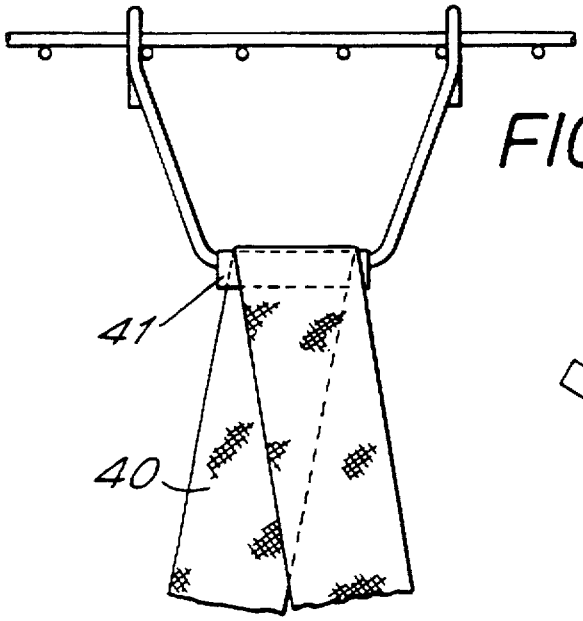
FIG. 10 is a plan view of a connector attached to a geotextile strip.
Figure 11:
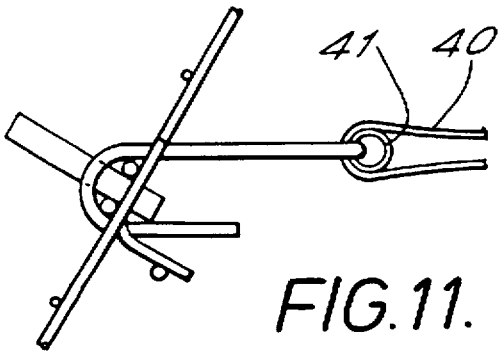
FIG. 11 is a side view of the connector of FIG. 10.

FIGS. 10 and 11 show an embodiment in which geosynthetic strips 40 are used to stabilise the earth. The arrangement is generally similar to the previously described embodiments, except that a tube 41 is placed on a bar before it is bent to the correct shape to form the connector 2. The stabilising strip 40 loops round the tube 41 so as to have upper and lower portions which diverge as they extend rearwardly into the earth behind the facing.

The invention also extends to methods of constructing earth structures as described herein in broad terms and also in more specific terms.

We claim:

1. An earth structure comprising a plurality of elongate stabilising elements in an earth mass behind a mesh facing, and a plurality of connectors behind the facing and connecting the facing to the stabilising elements, each connector having a rear attachment portion attached to a respective earth stabilising element, and having at least two spaced apart front attachment portions attached to the mesh facing.

2. An earth structure as claimed in claim 1, wherein the front attachment portions of the connectors comprise hooks which pass round at least one substantially horizontal bar of the mesh facing.

3. An earth structure as claimed in claim 1 or 2, wherein the mesh facing comprises mesh panels arranged one above another, and wherein the front attachment portions of the connectors connect a substantially horizontal bar of a lower facing panel with a substantially horizontal bar of an upper facing panel arranged above the lower facing panel, the connectors being arranged to permit relative vertical movement between the lower and upper facing panels.

4. An earth structure as claimed in claim 1, wherein the stabilising elements are in the form of strips which stabilise the earth by frictional interaction therewith, and wherein the rear attachment portions of the connectors extend laterally.

5. An earth structure as claimed in claim 4, wherein the stabilising strips are attached to the connectors by ties which loop round the laterally extending rear attachment portions.

6. An earth structure as claimed in claim 4, wherein the stabilising strips are attached to the connectors by looping round the laterally extending rear attachment portions, whereby each strip has first and second portions which extend rearwardly from its respective connector.

7. An earth structure as claimed in claim 1, comprising a first region of earth of a first type adjacent to the mesh facing, whereby the connectors are located in the first region, and a second region of earth of a second type behind the first region, whereby the stabilizing elements are located in the second region.

8. An earth structure as claimed in claim 7, wherein the first and second regions of earth are substantially separated by geosynthetic material.

9. An earth structure comprising a plurality of elongate stabilising elements in an earth mass behind a facing, and a plurality of connectors provided separately of the facing and extending there behind to connect the facing to the stabilising elements, each connector having a generally straight laterally extending rear attachment portion attached to a respective earth stabilising element, at least two spaced apart front attachment portions attached to the facing, and a pair of rearwardly extending portions converging towards said rear attachment portion.

10. An earth structure as claimed in claim 9, wherein each front attachment portion is attached to a bar or lug of the facing.

11. An earth structure as claimed in claim 9 or 10, wherein the facing comprises a plurality of panels arranged one above another and each front attachment portion is attached to the facing at a joint between vertically adjacent panels.

* * * * *